US012485338B1

(12) United States Patent
Cereno

(10) Patent No.: US 12,485,338 B1
(45) Date of Patent: Dec. 2, 2025

(54) HEATED SKATE BLADE WITH APP-CONTROLLED TEMPERATURE ADJUSTMENT

(71) Applicant: Matthew Cereno, Canton, MA (US)

(72) Inventor: Matthew Cereno, Canton, MA (US)

( * ) Notice: Subject to any disclaimer, the term of this patent is extended or adjusted under 35 U.S.C. 154(b) by 0 days.

(21) Appl. No.: 19/272,500

(22) Filed: Jul. 17, 2025

(51) Int. Cl.
*A63C 1/30* (2006.01)

(52) U.S. Cl.
CPC ..... *A63C 1/30* (2013.01); *A63C 2203/12* (2013.01)

(58) Field of Classification Search
CPC ..... A63C 1/30; A63C 2203/12; A63C 1/32; A63C 1/00
See application file for complete search history.

(56) References Cited

U.S. PATENT DOCUMENTS

| | | | |
|---|---|---|---|
| 6,988,735 | B2 * | 1/2006 | Furzer |
| 7,896,363 | B2 * | 3/2011 | Lovejoy |
| 9,950,243 | B2 * | 4/2018 | Evans |
| 10,376,771 | B2 * | 8/2019 | Rouzier |
| 2025/0121906 | A1 * | 4/2025 | Tett |

FOREIGN PATENT DOCUMENTS

| | | | | |
|---|---|---|---|---|
| WO | WO-2022009245 | A1 * | 1/2022 | ..... A63C 5/056 |
| WO | WO-2024226680 | A2 * | 10/2024 | ..... A63C 5/085 |

* cited by examiner

*Primary Examiner* — James A Shriver, II
*Assistant Examiner* — Nicholas R. Kandas
(74) *Attorney, Agent, or Firm* — Law Office of Ilya Libenzon

(57) ABSTRACT

A heated skate blade system is disclosed for optimizing ice skating performance through app-controlled temperature adjustment. The system includes a nichrome heating coil embedded in or adjacent to the blade, powered by a thin-film lithium-ion battery integrated into the blade holder. A micro-controller governs power delivery to the coil and wirelessly communicates with a mobile application via Bluetooth. The application enables users to input variables such as ice temperature, skater weight, skate size, blade hollow (ROH), and desired blade temperature. Based on these inputs, the system adjusts heating output to reduce the coefficient of kinetic friction between the blade and ice, enhancing glide and top speed. A USB-C port enables battery charging. The invention provides real-time, user-specific thermal tuning for hockey and speed skating applications, delivering improved speed and energy efficiency through compact, embedded electronics and an intuitive mobile interface.

20 Claims, 4 Drawing Sheets

HEATED SKATE BLADE WITH APP-CONTROLLED TEMPERATURE ADJUSTMENT

TECHNICAL FIELD

The present invention relates generally to the field of ice skate equipment and performance optimization systems. More particularly, it pertains to temperature-regulated skate blades that utilize embedded heating elements to reduce friction between the blade and the ice surface. The invention further relates to electronically controlled heating systems integrated into sports equipment, and specifically to systems that enable wireless, app-based adjustment of blade temperature via microcontroller-based interfaces and mobile devices.

BACKGROUND

Ice skating performance, whether in hockey, speed skating, or recreational contexts, is significantly influenced by the coefficient of kinetic friction ($\mu_k$) between the skate blade and the ice surface. A lower $u_k$ allows the skater to achieve higher speeds with less effort and improved maneuverability. This friction is largely mediated by the formation of a thin layer of water between the blade and the ice, which can be enhanced by slightly heating the blade. However, existing skate blades typically remain at ambient ice temperature, which can be as low as −5° C., resulting in a relatively high coefficient of kinetic friction (e.g., $\mu_k \approx 0.007$). Under such conditions, a skater weighing approximately 190 pounds using a standard 280 mm blade may be limited to top speeds of around 13.89 miles per hour due to energy loss from excessive resistance.

To overcome this limitation, there is a need for a skate blade system that can dynamically and precisely control its temperature to reduce $\mu_k$ to more optimal levels (e.g., $\mu_k \approx 0.004$), thereby enabling faster skating speeds, up to approximately 18.38 miles per hour for the same skater. Moreover, such a system must be compact, lightweight, and unobtrusive, integrating seamlessly into existing skate designs without compromising balance or structural integrity.

The present disclosure addresses these needs by providing a heated skate blade system powered by a compact thin-film lithium-ion battery and controlled wirelessly through a mobile application. This app-based interface allows users to input individual parameters such as ice temperature, skater weight, skate size, and desired blade temperature. The system then optimizes power delivery to an embedded nichrome coil heating element, achieving efficient and personalized performance enhancement in real time.

SUMMARY

The present disclosure provides a heated skate blade system designed to improve ice skating performance by dynamically reducing the coefficient of kinetic friction between the blade and the ice. The system includes an electrically resistive heating element, such as a nichrome coil, embedded within or adjacent to the skate blade. This heating element is powered by a compact thin-film lithium-ion battery integrated into the blade holder or adjacent structure, enabling continuous heating of the blade surface within an optimized temperature range of approximately 2° C. to 4° C.

To enable precise and customizable control, the system incorporates a microcontroller, such as an ESP32, which governs the power supplied to the heating coil. The microcontroller communicates wirelessly via Bluetooth with a mobile application installed on a user's smartphone or tablet. Through this app, the user can input key variables, including ice temperature, skater weight, skate size, blade hollow radius (ROH), and desired blade temperature. Based on these parameters, the system calculates and adjusts the heating output to minimize kinetic friction, thereby optimizing glide performance and energy efficiency.

The mobile application features a streamlined user interface with input fields for relevant skating conditions and a user-activated "Set" button that transmits the configured data to the microcontroller. Once applied, the system automatically adjusts the heating coil's output to maintain the desired blade temperature. This level of control allows for real-time tuning in accordance with environmental conditions and individual skater needs.

The invention enables a measurable improvement in skating speed, allowing a skater weighing approximately 190 pounds and using a 280 mm blade to increase their top speed from about 13.89 miles per hour (with an unheated blade) to approximately 18.38 miles per hour when the blade temperature is properly regulated. The system is designed for compatibility with iOS and Android devices and is suitable for use in both hockey and speed skating applications.

By combining compact power storage, precise electronic control, and an intuitive user interface, the invention offers a modern, app-integrated solution to enhance skating performance through optimized blade temperature control.

Other aspects, embodiments and features of the device and method will become apparent from the following detailed description when considered in conjunction with the accompanying figures. The accompanying figures are for schematic purposes and are not intended to be drawn to scale. In the figures, each identical or substantially similar component that is illustrated in various figures is represented by a single numeral or notation. For purposes of clarity, not every component is labeled in every figure. Nor is every component of each embodiment of the device and method shown where illustration is not necessary to allow those of ordinary skill in the art to understand the device and method.

BRIEF DESCRIPTION OF THE DRAWINGS

The preceding summary, as well as the following detailed description of the disclosed device and method, will be better understood when read in conjunction with the attached drawings. It should be understood, however, that neither the device nor the method is limited to the precise arrangements and instrumentalities shown.

DETAILED DESCRIPTION

Figure 1:
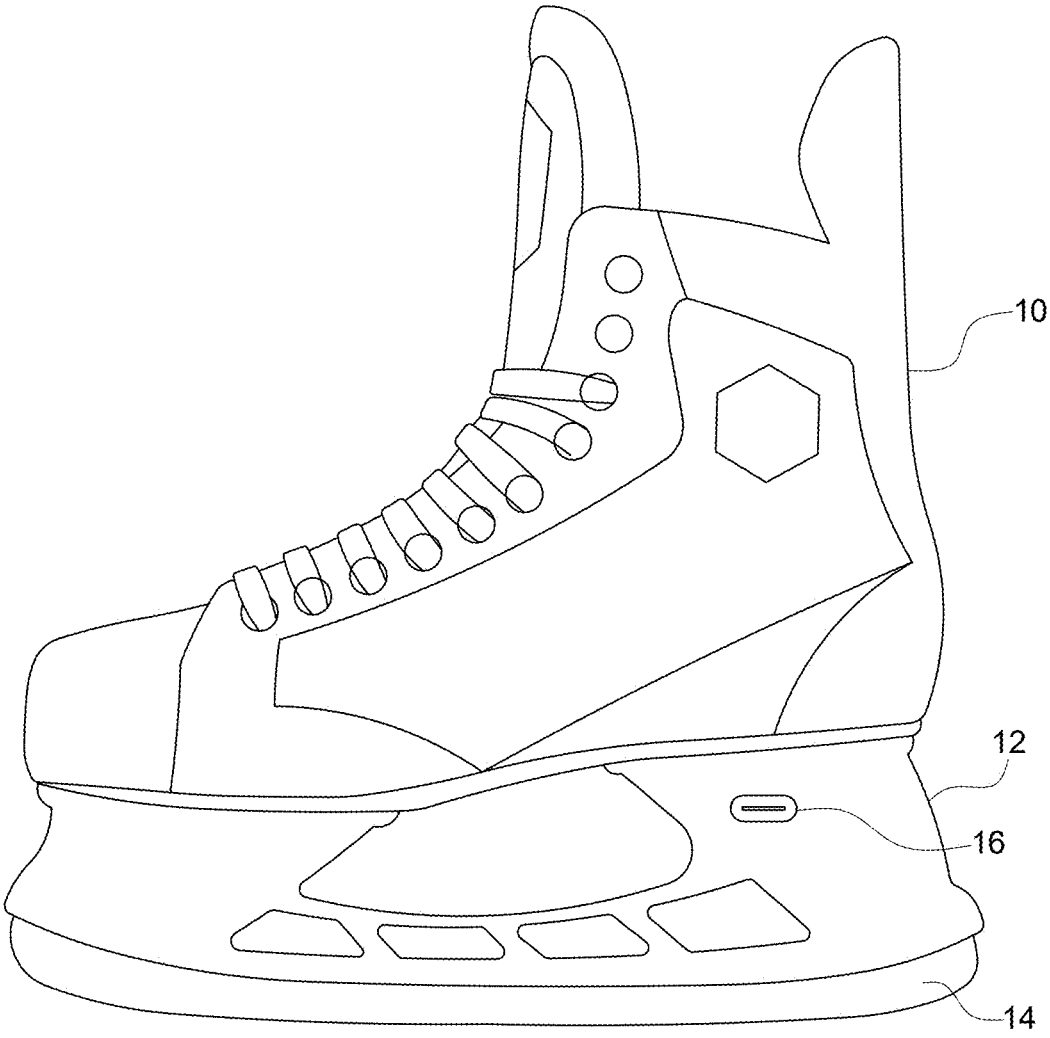
FIG. 1 is a side view of an ice skate incorporating the heated blade system, illustrating the skate boot, blade holder, blade, and a USB-C charging port integrated into the structure.

Referring first to FIG. 1, the heated skate blade system is integrated into a conventional ice skate, which includes a skate boot (10), a blade holder (12), and a stainless-steel blade (14). A USB-C port (16) is accessible on the outer side of the blade holder, enabling charging of the internal battery. The blade holder (12) is formed from high-strength nylon and has approximate dimensions of 50×30×10 mm. It is securely mounted to the skate boot (10) using rivets, consistent with conventional attachment methods.

Figure 2:
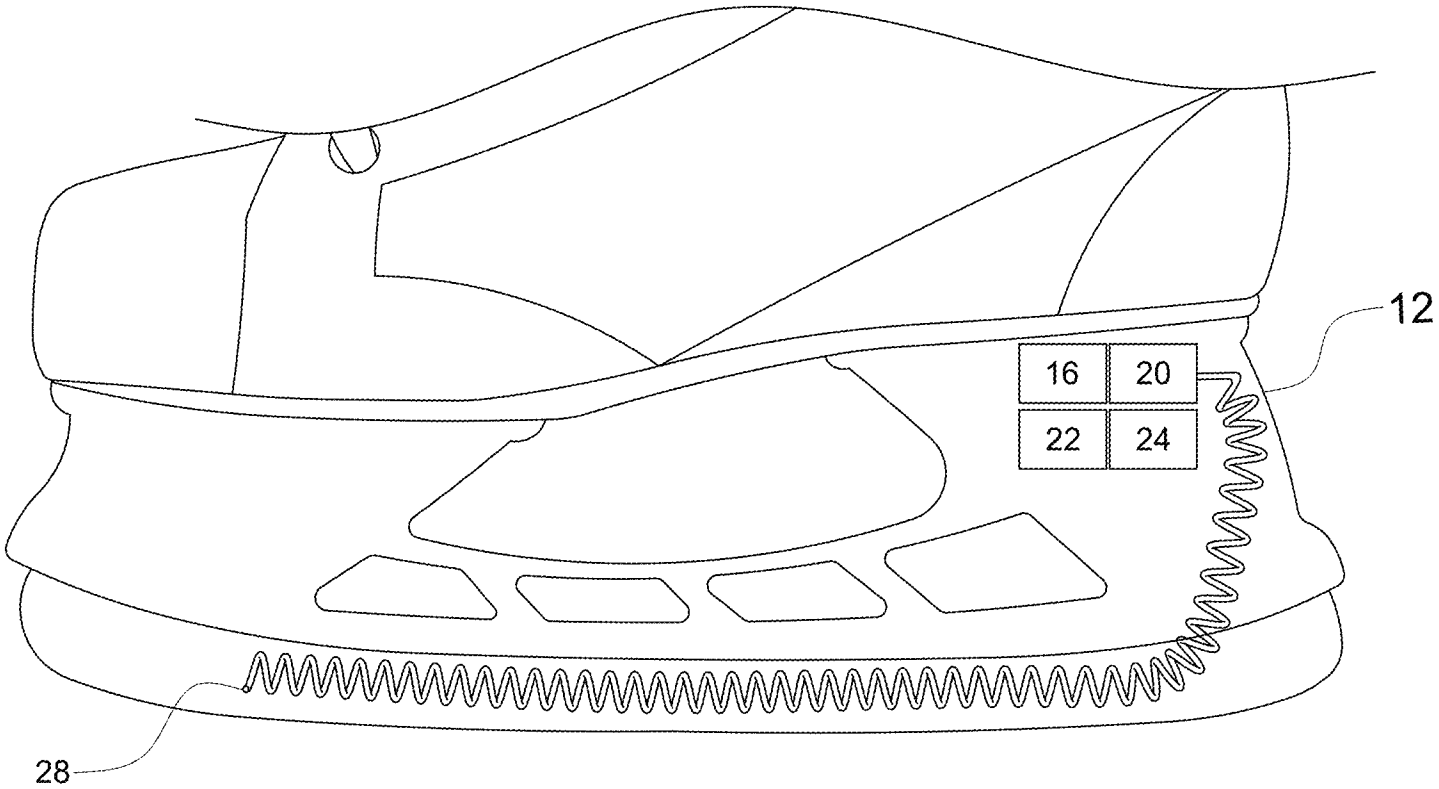
FIG. 2 is a cross-sectional view of the blade holder, showing internal components of the heating system, including a thin-film lithium-ion battery, microcontroller, nichrome heating coil, and electrical connectors.

Turning to FIG. 2, a cross-sectional view of the blade holder reveals the internal components of the system. Housed within the blade holder (12) is a thin-film lithium-ion battery (20), an ESP32 microcontroller (22), a JST-PH connector (24), and a nichrome heating coil (28) that is routed through the blade and extends into the blade holder. The coil is insulated with PTFE and embedded along the length of the blade (14), which is typically 254 to 304 mm long and 3 mm wide, depending on skate size. The blade's radius of hollow (ROH) may range from ⅜" to 1", with tighter hollows (e.g., ⅜") generating slightly higher friction coefficients ($\mu_k \approx 0.0045$) and shallower hollows (e.g., 1") yielding lower values ($\mu_k \approx 0.0035$). The nichrome coil (28), approximately 0.5 mm in diameter, heats the blade to a controlled temperature between 2° C. and 4° C., regulated to within +0.5° C. for optimal friction reduction.

Figure 3:
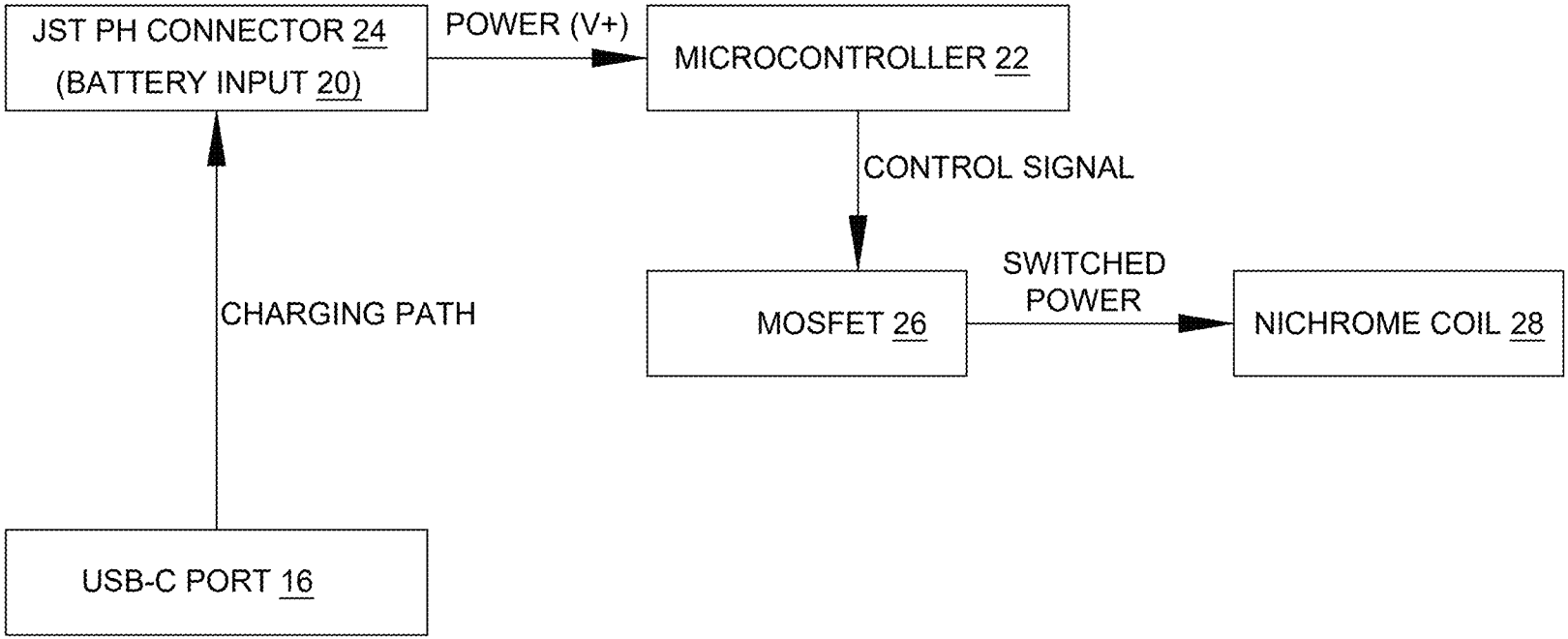
FIG. 3 is a schematic diagram illustrating the electrical configuration of the heating system, showing the connection of the nichrome coil to the battery through a MOSFET controlled by a microcontroller, with optional input from a mobile application.

FIG. 3 illustrates a schematic diagram of the electrical configuration. In one embodiment, the nichrome coil (28) is connected directly to the battery (20) through the JST-PH connector (24), allowing simple current delivery for heating. In a preferred embodiment, however, the coil is connected through a MOSFET (26) that is in turn controlled by the ESP32 microcontroller (22). This allows dynamic switching and modulation of the heating cycle according to real-time data input from the user via a mobile application.

The battery (20) is a high-capacity, thin-film lithium-ion cell rated at 3.7V and 9000 mAh (~33.3 Wh), measuring approximately 50×30×2.5 mm and weighing around 111 grams. Its internal structure includes a lithium cobalt oxide ($LiCoO_2$) cathode, a LiPON solid-state electrolyte, and a silicon or lithium-based anode with carbon nanotube (CNT) current collectors. The materials are deposited using RF magnetron sputtering, providing high energy density (~300 Wh/kg, ~600-800 Wh/L). The battery supports approximately one hour of active heating at a 50% duty cycle (average power ~28.25 W at ~15.3 A), with internal testing indicating that total operational runtime can exceed two hours under standard usage conditions.

A compact battery management system (BMS) is integrated into the assembly (~5×5×2 mm), providing overcurrent, overvoltage, and thermal protection, which is especially important in high-impact activities like hockey. Charging is achieved via the USB-C port (16), which delivers full charge within approximately two to four hours using a compatible 3.7V Li-ion charger. Compared to earlier blade-heating systems, the present battery is more compact yet delivers significantly higher capacity and runtime.

The ESP32 microcontroller (22) is a compact, Bluetooth-enabled control module (approximately 10×10×2 mm) that communicates wirelessly with a companion mobile application. The application, compatible with both iOS and Android devices, enables users to input various parameters including ice temperature (ranging from −10° C. to 0° C.), skater weight (50 to 250 lbs), skate size (U.S. size 6 to 12), and the blade's ROH. These inputs are processed by an embedded control algorithm, which calculates the optimal blade temperature using a multivariable formula:

$$T_blade = T_ice - 0.007 \times P + (18 - 0.5 \times P) + T_ROH$$

In this formula, P represents blade pressure in megapascals (MPa), calculated as P=(m×g)/(blade length×0.003), where m is the skater's mass in kilograms, g is gravitational acceleration (9.81 $m/s^2$), and blade length is in meters. The term T_ROH adjusts for the radius of hollow: approximately +1.5° C. for a ⅜" ROH and −1.5° C. for a 1" ROH. For example, with a skater weight of 190 lbs (approximately 86.2 kg), ice temperature of −5° C., a blade length of 280 mm, and an ROH of ½", the calculated blade temperature is approximately 3° C.

For example, under typical conditions—ice temperature of −5° C., skater weight of 190 lbs, blade length of 280 mm, and an ROH of ½"—the estimated blade temperature would be approximately 3° C. The microcontroller adjusts the MOSFET (26) to regulate current to the coil (28), achieving intermittent heating with a duty cycle of approximately 50%, thus maintaining the desired temperature range while minimizing power consumption.

The PTFE insulation (not shown in detail in FIG. 2 but identified as insulation layer 26 in the schematic of FIG. 3) lines the inner surface of the blade holder to thermally isolate the heating circuit from the skate boot and surrounding materials. PTFE provides a high convective insulation rating (~100 $W/m^2 \cdot K$), ensuring efficient thermal retention within the blade structure.

In operation, the user launches the mobile application and inputs skating conditions, including ice temperature, skater weight, skate size, and blade ROH. The system calculates the target blade temperature—typically between 2° C. and 4° C.—to achieve a reduced coefficient of kinetic friction ($\mu_k \approx 0.004$). The calculated settings are transmitted to the ESP32 microcontroller (22), which then adjusts power to the nichrome coil (28) via the battery (20) and JST-PH connector (24). As a result, the blade maintains optimal temperature during skating, allowing enhanced glide and increased top speed. For example, for a 190 lb skater on −5° C. ice, top speed may increase from approximately 13.89 mph (unheated) to around 18.38 mph (heated).

The system offers several advantages. It significantly reduces kinetic friction, increasing skating speed by 4 to 5 mph. It provides precise, app-based thermal control tailored to both environmental and individual skater parameters, in contrast to fixed-temperature solutions. The use of a thin-film lithium-ion battery provides compactness and superior energy capacity compared to earlier implementations. Reliability is enhanced through a robust nichrome heating coil, PTFE insulation, and integrated battery safety features. Furthermore, the system is versatile and suitable for both hockey and speed skating applications, with adjustable settings for ROH and user weight.

The present invention provides a significant performance advantage by enabling skaters to achieve higher speeds-approximately 18.38 miles per hour compared to 13.89 miles per hour with conventional unheated blades-through real-time optimization of the coefficient of kinetic friction ($\mu_k$), which is reduced to approximately 0.004. The integration of a thin-film lithium-ion battery (20) delivers reliable and sustained power in a highly compact form factor, supporting extended operation without compromising the skate's balance or structure. The system enables reproducible and precisely controlled blade temperatures tailored to individual skating conditions and user parameters. These functional and technical benefits support the utility, novelty, and non-obviousness of the invention, thereby meeting key requirements for patentability under applicable standards.

Figure 4:
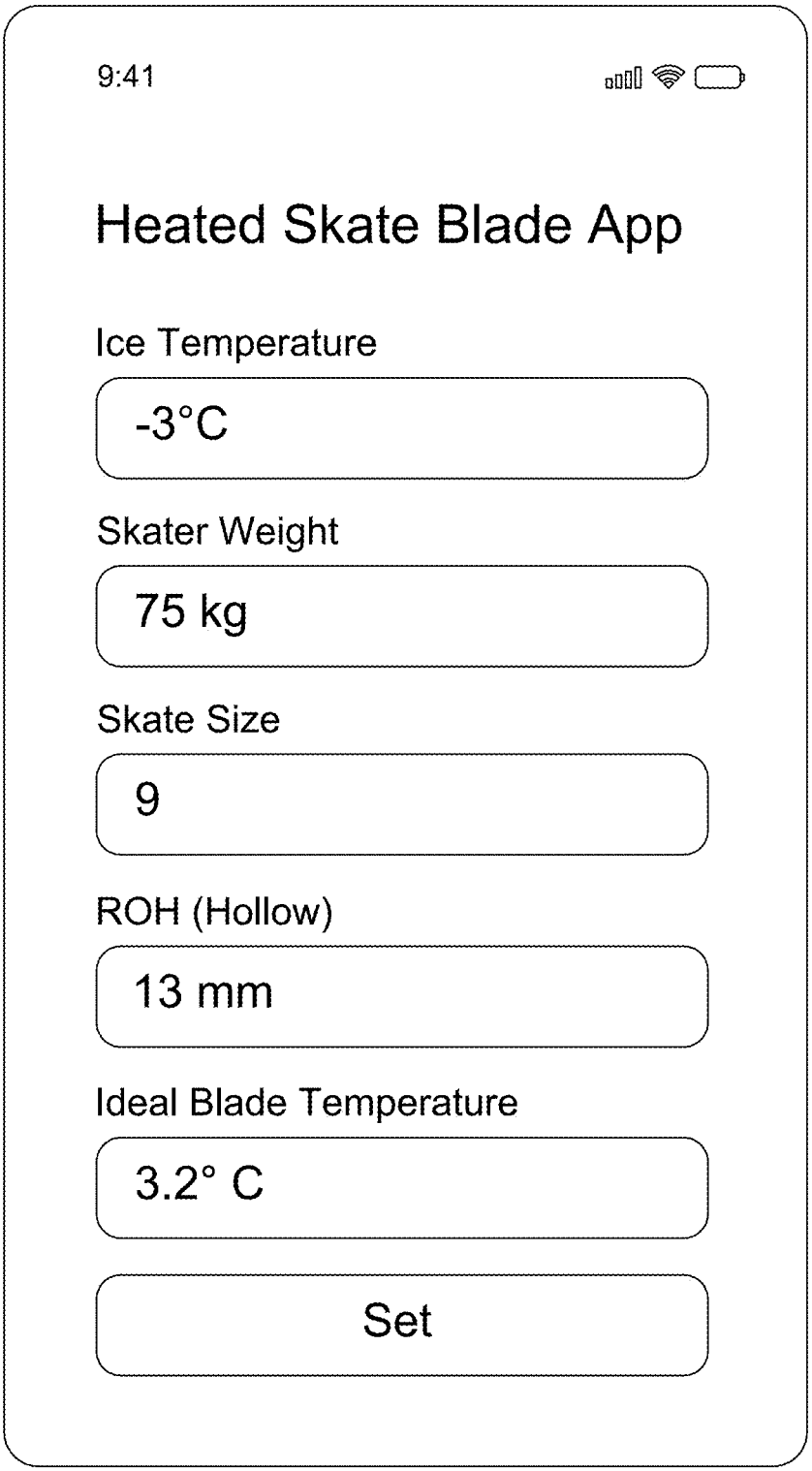
FIG. 4 is a depiction of the mobile application interface, showing user input fields for ice temperature, skater weight, skate size, blade radius of hollow (ROH), and target blade temperature, along with a "Set" button for transmitting configuration data to the skate system.

As shown in FIG. 4, the Heated Skate Blade App features a sleek and user-friendly interface designed to enhance ice skating performance through precise thermal control. The application allows users to input key variables, including ice temperature, skater weight, skate size, radius of hollow (ROH), and the desired blade temperature. Based on these parameters, the system adjusts the blade's heating range, typically between 2° C. and 4° C., to achieve minimal kinetic friction ($\mu_k$ 0.004). A prominently displayed green "Set" button transmits the user-defined settings via Bluetooth to an onboard ESP32 microcontroller, which regulates power to the nichrome heating coil accordingly. Compatible with both iOS and Android devices, the app delivers real-time, skater-specific temperature tuning, improving glide efficiency and enabling top skating speeds of up to approximately 18.38 mph. The system is powered by a thin-film lithium-ion battery integrated into the blade holder, offering a compact, efficient, and modern solution for high-performance hockey and speed skating.

In accordance with some embodiments of the present disclosure, the Heated Skate Blade App may further enhance its utility by incorporating additional skating performance metrics, such as real-time speed, time on ice, and stride length. These parameters, commonly monitored by advanced athletic tracking systems such as HELIOS, provide valuable insights for competitive skaters seeking data-driven optimization. In some implementations, these metrics are acquired using integrated sensors, including GPS modules for tracking velocity and inertial measurement units (IMUs) or accelerometers for detecting stride cadence and length. These sensors may be communicatively paired with the existing ESP32 microcontroller, allowing synchronized collection of biomechanical and environmental data.

The integration of such metrics may enable intelligent adjustments to blade temperature, duty cycle, or even radius of hollow, based on real-time performance feedback. For example, sustained high-speed skating could trigger an automated increase in blade temperature to maintain low kinetic friction while optimizing power usage. This adaptive approach has the potential to extend battery efficiency and enhance skater endurance across varying intensities of activity.

Hardware support for this functionality may involve the addition of compact sensor modules embedded within or adjacent to the blade holder, as well as software upgrades to process and interpret the incoming data. While such enhancements may impose additional power demands, the existing 9000 mAh thin-film lithium-ion battery is expected to accommodate this functionality through minor adjustments to heating duty cycles or operating intervals. For example, rather than operating on fixed or continuous heating cycles, the system may implement adaptive pulsed heating, where the nichrome coil is activated in short bursts based on real-time thermal feedback or performance thresholds-such as sudden changes in skating speed or environmental ice temperature. During low-activity periods (e.g., resting, gliding, or stoppage), the control algorithm may increase the off-cycle duration to conserve energy while maintaining sufficient residual blade warmth.

In accordance with some embodiments of the present disclosure, these power optimizations are further managed by an integrated battery management algorithm that monitors voltage, current, and temperature data to dynamically adjust both heating output and sensor sampling frequency. For instance, if the battery level falls below a predefined threshold, the system may reduce sensor polling intervals or temporarily suspend non-essential data processing functions while preserving core heating performance. Conversely, when battery capacity is high, the algorithm may permit higher-resolution tracking and more frequent thermal adjustments.

This intelligent power budgeting strategy allows the system to maintain both data processing and temperature regulation under varying usage conditions without degrading runtime. The fallback behavior ensures uninterrupted operation of the heating function even if auxiliary features, such as stride analysis or speed monitoring, are temporarily throttled. Such integration enhances the reliability, efficiency, and adaptability of the system in both recreational and high-performance environments.

In accordance with embodiments of the present disclosure, the heating control system dynamically determines and maintains an ideal blade temperature based on a combination of user-specific and environmental variables. These key parameters include the skater's weight and height (which influence pressure applied to the ice), the radius of hollow (ROH) of the blade, the blade dimensions (which may vary by skate size), and the ambient ice temperature. Each of these factors plays a role in modulating the pressure melting and frictional heating dynamics that govern the formation of a lubricating meltwater layer beneath the skate blade. By precisely tailoring the blade temperature in response to these inputs, the system minimizes the coefficient of kinetic friction (μ_k) during skating and gliding phases.

Ice skating performance relies fundamentally on the presence of a thin meltwater layer between the skate blade and the ice. This layer is produced through a combination of pressure-induced melting—resulting from the downward force of the skater's mass—and frictional heating generated as the blade moves across the ice surface. The temperature of the blade directly influences the rate at which this meltwater layer is formed and sustained. A warmer blade introduces additional heat, which can modestly increase the meltwater film thickness, further reducing friction. Conversely, a colder blade may slow meltwater formation and increase resistance. As the ice is already at or near its melting point, the role of blade temperature is nuanced and must be finely tuned in real time to maintain the optimal glide interface.

Once a skater reaches a cruising speed-such as 15 miles per hour-friction becomes the primary force of deceleration during gliding. The distance traveled before coming to a stop, referred to as the glide distance, depends on the skater's initial velocity, mass, and the frictional force opposing motion. The glide distance s can be approximated by the expression:

$$s=u^2/(2\times\mu_k\times g)$$

where u is the initial speed and g is gravitational acceleration. Using typical values (e.g., u=6.71 m/s, g=9.81 m/s$^2$), glide distance becomes inversely proportional to μ_k, meaning that minimizing μ_k maximizes s. Therefore, even minor improvements in thermal blade regulation can yield measurable increases in glide efficiency and skating endurance.

The invention is not limited to any particular type or configuration of battery, microcontroller, or heating element.

Although some embodiments describe a thin-film lithium-ion battery for illustrative purposes, alternative power sources—including newer battery chemistries, smaller form factors, or increased energy densities—may be substituted without departing from the scope of the invention. This flexibility enables integration of the heating and control system into a wide range of commercial skate products offered by manufacturers such as Bauer, CCM, or others, either through OEM collaboration, modular inserts, or embedded design.

The invention does not require the development of a new ice skate as such, but rather enables the adaptation and enhancement of existing skate platforms through embedded, app-controlled thermal regulation technology. However, in accordance with some embodiments, the invention may also be integrated into a complete skate system developed from the ground up (e.g., a proprietary skate boot, holder, and blade assembly), allowing for optimal placement, mechanical integration, and performance tuning of the heating components and control electronics as part of a vertically integrated product offering.

In accordance with embodiments of the present invention, as already reduced to practice, the app interface and hardware platform support advanced performance tracking features, including real-time speed monitoring, stride cadence, and time-on-ice analytics. These metrics are obtained through integrated sensors such as GPS modules, accelerometers, or inertial measurement units (IMUs), and transmitted wirelessly to the onboard microcontroller for concurrent processing alongside thermal control logic. The system's algorithm interprets these metrics to make data-driven decisions about power delivery and heating duty cycles, allowing skaters to optimize blade temperature relative to activity intensity, fatigue, and ice conditions. This combined functionality enhances not only glide efficiency but also offers actionable feedback to the athlete for improved technique and endurance management.

In additional embodiments, the principles of the present invention may be extended to other sports in which the regulation of surface friction is critical to performance. For example, in alpine ski racing or ski jumping, glide optimization plays a pivotal role in time and distance outcomes. Although ski materials and surface characteristics differ significantly from those of ice skates, the underlying control logic-modulating the temperature of a contact surface based on user and environmental inputs-remains applicable. The same app-based interface and sensor integration architecture developed for skate blades may serve as the control foundation for thermal tuning in skis or other sport-specific platforms where friction modulation improves performance.

TABLE 1

Optimized Blade Temperature and Performance Gains Across Skater Profiles

| Scenario | Ice Temp (° C.) | Skater Height (inches) | Skater Weight (lbs) | Un-heated speed (mph) | Ideal Blade Temp (° C.) | New speed (mph) | Speed increase (mph) | Speed increase (%) |
|---|---|---|---|---|---|---|---|---|
| 1 | −5 | 56 | 75 | 14 | 3.5 | 18 | 4 | 28.57 |
| 1 | −5 | 68 | 150 | 17 | 3 | 21.5 | 4.5 | 26.47 |
| 1 | −5 | 73 | 190 | 20 | 2.5 | 25 | 5 | 25 |
| 2 | −7 | 56 | 75 | 14 | 4 | 17.8 | 3.8 | 27.14 |
| 2 | −7 | 68 | 150 | 17 | 3.5 | 21.3 | 4.3 | 25.29 |
| 2 | −7 | 73 | 190 | 20 | 3 | 24.8 | 4.8 | 24 |
| 3 | −1 | 56 | 75 | 14 | 2 | 18.2 | 4.2 | 30 |
| 3 | −1 | 68 | 150 | 17 | 2.3 | 21.7 | 4.7 | 27.65 |
| 3 | −1 | 73 | 190 | 20 | 2 | 25.2 | 5.2 | 26 |

The table 1 above illustrates the performance impact of optimized blade temperature based on varying skater profiles and ice conditions. In accordance with embodiments of the present invention, the system dynamically adjusts blade temperature to achieve a significant reduction in kinetic friction, thereby improving top skating speed. For each skater profile, the app of the present disclosure calculates an ideal blade temperature based on key variables including ice temperature, skater height, skater weight, and blade dimensions. The following constants were used in the calculations reflected in Table 1: radius of hollow (ROH)=½", unheated coefficient of kinetic friction ($\mu_k$)≈0.006, and heated $\mu_k$≈0.004. As shown in Table 1, adjusting the blade temperature from ambient ice conditions (unheated) to a controlled range of approximately 2.5° C. to 4° C. results in speed increases ranging from 3.8 to 5 mph, equivalent to 25% to nearly 29% improvement in performance. These results confirm the system's ability to deliver measurable and consistent speed gains across a range of user conditions through precise thermal regulation of the skate blade.

In accordance with embodiments of the present disclosure, and as illustrated in FIGS. 2 and 3, the microcontroller refers to the electronic processing component responsible for receiving user input, executing control logic, and regulating power delivery to the blade heating element. The microcontroller may be implemented using a low-power, integrated system-on-chip (SoC), such as the ESP32 (22) shown in FIG. 2, or an equivalent device capable of wireless communication, power management, and real-time computation. As depicted in FIG. 2, the microcontroller (22) is positioned within the blade holder (12) and is electrically coupled to both the heating coil (28) and the thin-film lithium-ion battery (20), allowing for controlled current delivery to achieve and maintain an optimal blade temperature.

As shown in FIG. 3, the microcontroller (22) receives configuration parameters-such as ice temperature, skater weight, skate size, and radius of hollow-wirelessly from a mobile application via a Bluetooth interface. Based on this input, the microcontroller computes a target blade temperature and regulates power to the heating coil (28) either directly or through a switching circuit such as the MOSFET (26). The microcontroller may implement pulse-width modulation (PWM) or duty-cycle control to conserve battery power while maintaining a consistent thermal output across varying skating conditions.

In certain embodiments, the microcontroller interfaces with additional sensing elements, such as thermistors or inertial measurement units (not shown), to enable closed-loop control or to respond dynamically to variations in user movement or environmental conditions. The microcontroller and associated components may be integrated into a printed circuit board (PCB) secured within the blade holder or encapsulated in a protective housing designed for use in high-impact environments such as hockey or speed skating.

The microcontroller, as described and shown in FIGS. 2 and 3, enables intelligent, app-controlled thermal regulation of the skate blade in real time, thereby minimizing friction and enhancing glide performance in accordance with the principles of the present invention.

In accordance with some embodiments of the present disclosure, the user-specific input used to calculate optimal blade temperature includes variables that directly affect frictional interaction with the ice, such as skater weight, ice temperature, blade size, and radius of hollow (ROH). Although skater height is not required for the friction or temperature control calculations, it may optionally be included as part of a broader skater profile to inform auxiliary parameters, such as estimated stride length or to assist in recommending appropriate skate size. In such embodiments, height may be used by the mobile application to enhance user personalization or diagnostics but does not directly affect the blade temperature control algorithm.

In an alternative embodiment, skater height is used as an active input in the calculation of blade temperature, either independently or in combination with weight and other parameters. For example, height may be used to compute a derived biomechanical value such as body mass index (BMI) or estimated pressure distribution over the blade length. These derived values may then be used by the microcontroller to refine the target blade temperature or heating duty cycle. In this embodiment, the control logic dynamically adjusts thermal output based on both mass and stature-related inputs to account for differences in force application, skating style, or center-of-gravity considerations, thereby enabling more individualized performance optimization.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

Although the invention is described herein with reference to specific embodiments, various modifications and changes can be made without departing from the scope of the present invention as set forth in the claims below. Accordingly, the specification and figures are to be regarded in an illustrative rather than a restrictive sense, and all such modifications are intended to be included within the scope of the present invention. Any benefits, advantages, or solutions to problems that are described herein with regard to specific embodiments are not intended to be construed as a critical, required, or essential feature or element of any or all the claims.

Unless stated otherwise, terms such as "first" and "second" are used to arbitrarily distinguish between the elements such terms describe. Thus, these terms are not necessarily intended to indicate temporal or other prioritization of such elements.

The foregoing detailed description is merely exemplary in nature and is not intended to limit the invention or application and uses of the invention. Furthermore, there is no intention to be bound by any expressed or implied theory presented in the preceding technical field, background, brief summary, or the following detailed description.

What is claimed is:

1. A skate blade system comprising:

a blade adapted for attachment to a skate boot;

a heating element thermally coupled to the blade;

a power source electrically connected to the heating element;

a microcontroller configured to regulate power to the heating element; and a wireless interface configured to receive user-defined input from a mobile application, wherein the user-defined input includes at least ice temperature, skater weight, skate size, and blade geometry, and wherein the microcontroller adjusts a target blade temperature based on the user-defined input to reduce kinetic friction during skating.

2. The skate blade system of claim 1, wherein the heating element comprises a nichrome coil embedded within or adjacent to the blade.

3. The skate blade system of claim 1, wherein the power source comprises a rechargeable lithium-ion battery disposed within a blade holder.

4. The skate blade system of claim 1, wherein the wireless interface comprises a wireless communication module configured to receive configuration parameters from the mobile application.

5. The skate blade system of claim 1, wherein the microcontroller maintains the blade temperature within a range of approximately 2° C. to 4° C.

6. A skate blade system for improving skating performance, comprising:

a stainless-steel blade having a radius of hollow between ⅜ inch and 1 inch;

a nichrome heating coil embedded along a longitudinal surface of the blade and insulated with a thermally stable polymer;

a thin-film lithium-ion battery disposed within a blade holder and electrically coupled to the heating coil;

an ESP32 microcontroller configured to control the current delivered to the heating coil;

a mobile application stored on a user device, the application configured to receive and transmit user-specific input including ice temperature, skater weight, skate size, and radius of hollow;

a wireless communication module configured to receive the user-specific input and transmit it to the microcontroller; and wherein the microcontroller calculates and maintains an optimal blade temperature based on the user-specific input, thereby reducing the coefficient of kinetic friction from approximately 0.006 to approximately 0.004.

7. The skate blade system of claim 6, wherein the battery has a capacity of at least 9000 mAh and powers the heating coil at a duty cycle of approximately 50% for at least one hour.

8. The skate blade system of claim 6, wherein the microcontroller regulates current to the heating coil through a MOSFET switching circuit.

9. The skate blade system of claim 6, further comprising a USB-C charging port electrically connected to the battery.

10. The skate blade system of claim 6, wherein the mobile application is configured to calculate blade temperature using an equation that accounts for pressure, ice temperature, and radius of hollow.

11. A method of using the skate blade system of claim 1, the method comprising:

providing user-specific input to the mobile application, the input including at least ice temperature, skater weight, skate size, and blade geometry;

wirelessly transmitting the user-specific input from the mobile application to the microcontroller via the wireless interface;

calculating, by the microcontroller, an optimal blade temperature based on the user-specific input;

delivering power from the power source to the heating element under the control of the microcontroller; and heating the blade to the calculated optimal blade temperature to reduce kinetic friction between the blade and the ice during skating.

12. The method of claim 11, wherein the optimal blade temperature is maintained within a range of approximately 2° C. to 4° C.

13. The method of claim 11, wherein the heating element comprises a nichrome coil embedded along a longitudinal portion of the blade.

14. The method of claim 11, wherein the user-specific input further includes the radius of hollow (ROH) of the blade, and the optimal blade temperature is calculated using an algorithm that adjusts for variations in ROH.

15. The method of claim 11, wherein the microcontroller adjusts the heating duty cycle based on real-time skating activity detected through onboard sensors.

16. The method of claim 11, further comprising monitoring the battery state of charge and modifying the heating profile to conserve power when battery capacity falls below a predetermined threshold.

17. The method of claim 11, wherein the wireless transmission is performed using a Bluetooth protocol and received by a microcontroller integrated within the blade holder.

18. The method of claim 11, further comprising displaying to the user, via the mobile application, a confirmation that the optimal blade temperature has been achieved.

19. The method of claim 11, wherein the coefficient of kinetic friction between the blade and the ice is reduced from approximately 0.006 to approximately 0.004.

20. A method for reducing kinetic friction between a skate blade and an ice surface, the method comprising: receiving user-specific input via a mobile application, the input including at least ice temperature, skater weight, skate size, and blade geometry; calculating an ideal blade temperature based on the user-specific input; transmitting the ideal blade temperature from the mobile application to a microcontroller via a wireless communication link;

regulating power from a battery to a heating element thermally coupled to the skate blade based on the calculated ideal blade temperature; and heating the blade to the ideal blade temperature to reduce the coefficient of kinetic friction during skating.

* * * * *